US006648185B1

(12) United States Patent
Henry et al.

(10) Patent No.: US 6,648,185 B1
(45) Date of Patent: Nov. 18, 2003

(54) ELECTRIC PRE-MIX DISPENSING VALVE

(75) Inventors: Paul J. Henry, Andover, MN (US); Stephen J. Czeck, Shoreview, MN (US)

(73) Assignee: IMI Cornelius Inc., Anoka, MN (US)

( * ) Notice: Subject to any disclaimer, the term of this patent is extended or adjusted under 35 U.S.C. 154(b) by 0 days.

(21) Appl. No.: 09/631,077

(22) Filed: Aug. 2, 2000

Related U.S. Application Data

(60) Provisional application No. 60/147,239, filed on Aug. 4, 1999.

(51) Int. Cl.[7] ..... B67D 3/00; B67D 5/06

(52) U.S. Cl. ..... 222/505; 141/351; 141/360; 141/DIG. 2; 222/504; 222/517

(58) Field of Search ..... 222/504–507, 222/129.1, 511, 517; 141/351, 360, 362, DIG. 2

(56) References Cited

U.S. PATENT DOCUMENTS 3,738,543 A * 6/1973 Aperlo ..... 222/453
5,129,434 A * 7/1992 Whigham et al. ..... 141/362
5,129,549 A * 7/1992 Austin ..... 222/129.1
6,305,269 B1 * 10/2001 Stratton ..... 222/459

* cited by examiner

*Primary Examiner*—Timothy L. Maust
(74) *Attorney, Agent, or Firm*—Sten Eric Hakanson

(57) ABSTRACT

An electrically operated pre-mix valve includes a cup lever operable to activate a switch to energize a solenoid. The solenoid operates a first lever, which then contacts and operates a second lever. The second lever, in turn, moves against the contact end of an actuating shaft. The actuating shaft is thereby moved to permit beverage flow through the valve and out of a nozzle thereof. Thus, the valve herein uses a compound lever system to gain a mechanical advantage for substantially lessening the opening force required to be applied by the solenoid.

16 Claims, 5 Drawing Sheets

ELECTRIC PRE-MIX DISPENSING VALVE

This application claims the benefit of Provisional Application No. 60/147,239, filed Aug. 4, 1999

BACKGROUND OF THE INVENTION:

1. Field of the Invention

The present invention relates generally to pre-mix beverage dispensing valves and more particularly to solenoid operated beverage dispensing valves.

2. Background

Pre-mix beverage dispensing valves are well known in the art, and serve to dispense carbonated drinks such as soda pop and beer. These valves are designed to dispense a carbonated drink with a minimum of carbonation loss, to the atmosphere and by minimizing foaming. This result is accomplished primarily with a compensator positioned upstream of the valve seat that helps to reduce the pressure on the pre-mix, generally 50 to 80 pounds per square inch, to that of atmosphere. Prior art pre-mix valves have typically been manually operated wherein a lever is pulled toward the operator to dispense a drink. A spring provides for assisting in moving the valve back to the closed position and maintaining the valve closed and seated.

Various attempts have been made at making a pre-mix valve electrically operable, such as through the use of a solenoid. However, the initial force needed to overcome the pressure on the pre-mix beverage, as well as that of the shaft spring, has presented problems. An electrically operated valve is seen in U.S. Pat. No. 4,708,155 wherein a leveraged solenoid system utilizing a spring linkage is used to reduce the size and power consumption of the solenoid. However, further improvements involving lessening of the initial force required to open a pre-mix valve are required to insure long term reliable operation.

SUMMARY OF THE INVENTION

The present invention comprises a solenoid operated pre-mix beverage dispensing valve having low opening force requirements. The valve includes a valve body having an actuating shaft slideably mounted along a central axis thereof. The shaft includes a first contact end extending outward of a front end of the valve, and a second end positioned within the valve body. A spring is positioned around the shaft first end and between a spring retainer and the valve body. The valve body includes a radiussed circular seat surface tapering to a smooth cylindrical surface area. A quad-ring is retained in an annular grove extending around the actuating shaft and provides fluid tight sealing between the actuating shaft and the cylindrical surface area of the valve body. The actuating shaft also includes four stop tabs extending radially and equidistantly from and around a common perimeter of the actuating shaft. In the closed position of the valve the four tabs are in contact with the radiussed surface of the valve body and the quad ring is in sealing relationship with the cylindrical valve body surface.

A compensator housing is secured to an attachment end of the valve body and a compensator is positioned within the housing. The compensator includes a cylindrical bore for sealably receiving the second end of the actuating shaft. A further quad ring extending around the second end of the actuating shaft provides for fluid tight sealing between the second end and the compensator bore. An air pressure equalization channel extends axially through the center of the actuating shaft and provides air communication between the compensator bore and a transverse channel in the valve body. The transverse channel provides air communication to ambient air pressure.

A frame is secured to the exterior of the valve body and the frame structure provides for pivotal mounting thereto of a first lever arm. A second lever arm is pivotally secured to the frame and has a first end positioned between the first lever and the contact end of the actuating shaft. A solenoid is secured to a top surface of the valve body and includes an armature having an external end thereof for engaging with the first end of the first lever arm. A cup contact lever is pivotally suspended below the valve body and is operable to actuate a switch for energizing and de-energizing the solenoid.

In operation, the cup lever is moved to operate the switch, which then energizes the solenoid. The armature is then drawn into the solenoid thereby operating the first lever. The first lever then contacts the second lever which, in turn, moves against the contact end of the actuating shaft. The actuating shaft is made to then move against the biasing force of the spring and move the first quad-ring out of contact with the valve cylindrical surface and the four stop tabs out of contact with the radiussed surface. As a result thereof, beverage is permitted to flow between the actuating shaft and the valve body to the dispense nozzle.

Those of skill will recognize that the valve of the present invention uses a compound lever system to gain a mechanical advantage for substantially lessening the force required to initiate dispensing. In addition, the air pressure equalization system is improved over the prior art to further lessen the initial force required to open the valve. As a result of the lessened opening force, a lower power solenoid can be used resulting in a substantial increase in the reliability and longevity of the valve.

DESCRIPTION OF THE DRAWINGS

A better understanding of the structure, function, operation and advantages of the present invention can be had by referring to the following detailed description which refers to the following drawing figures, wherein:

FIG. 6 shows a perspective end view of the valve body.

DETAILED DESCRIPTION OF THE PREFERRED EMBODIMENT

Figure 1:
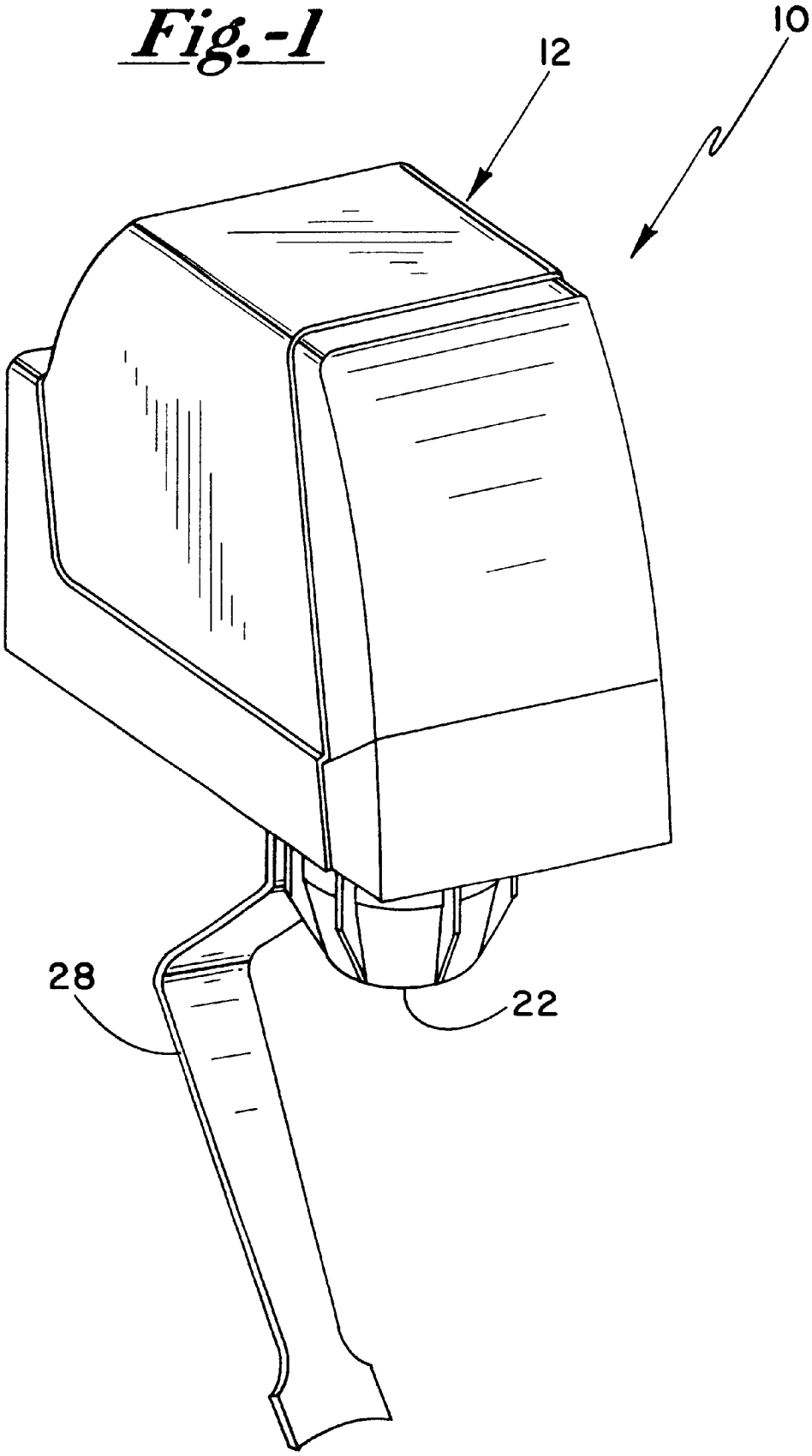
FIG. 1 shows a perspective view of the present invention.
Figure 2:
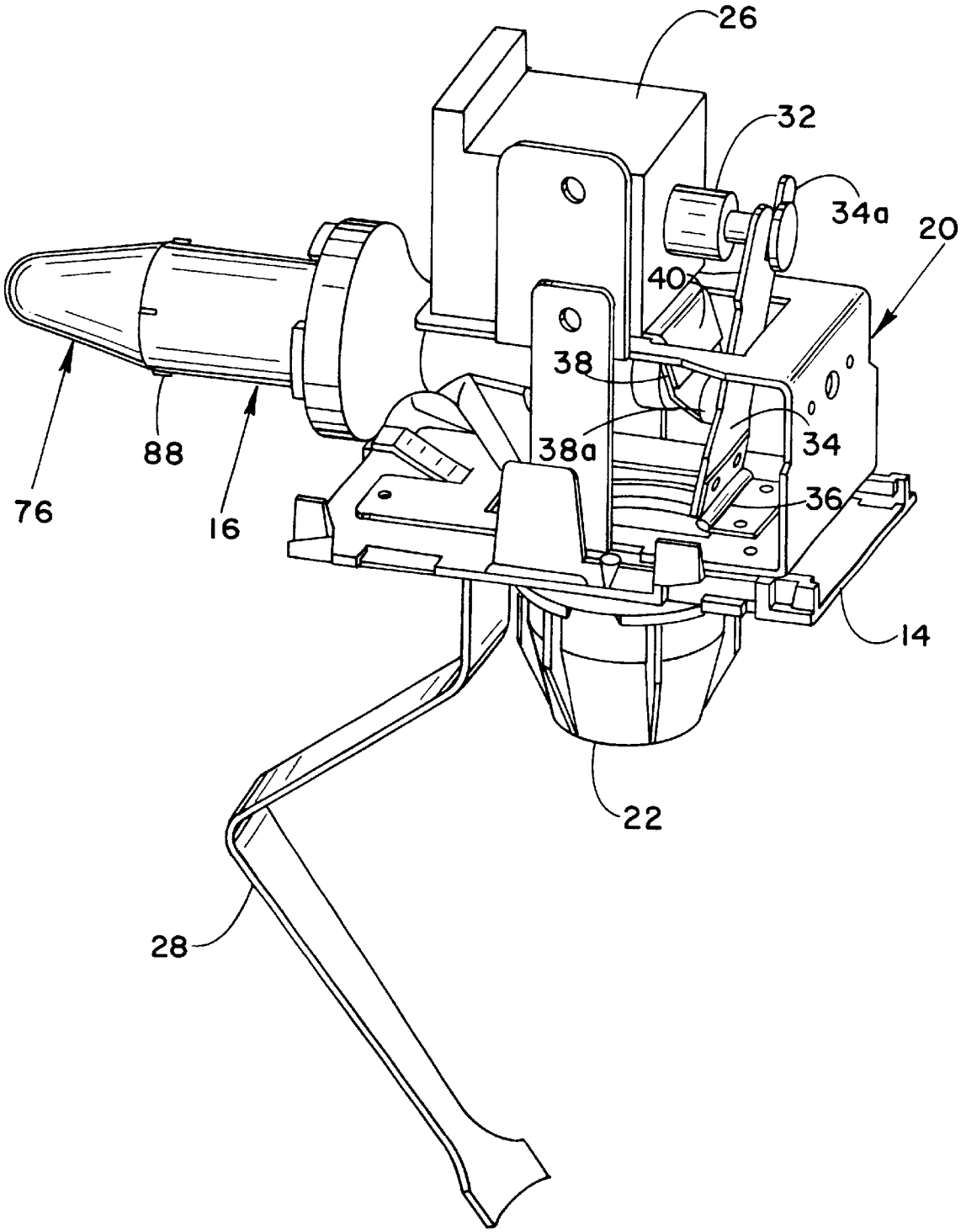
FIG. 2 shows a further perspective view of the present invention with the valve cover removed.
Figure 3:
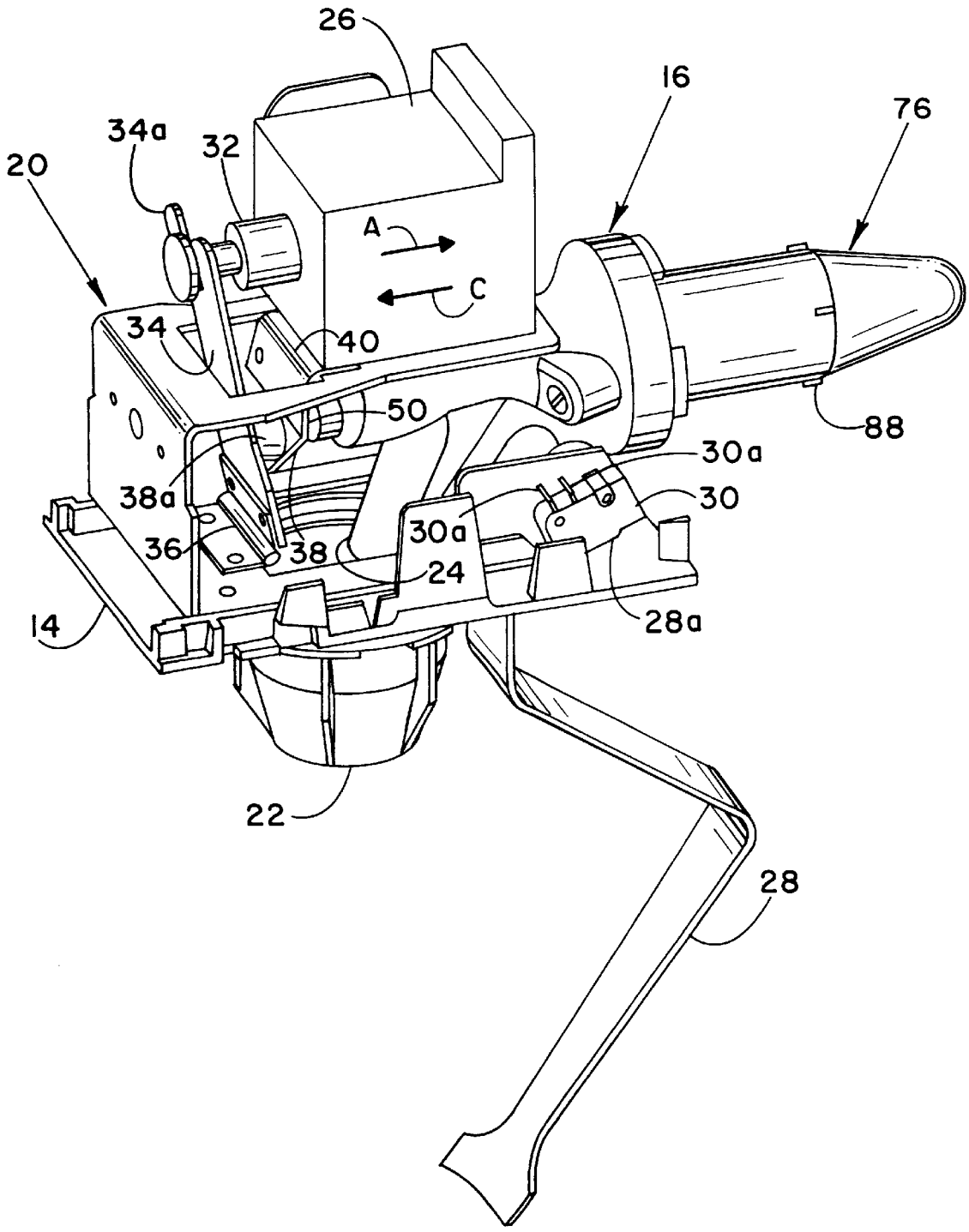
FIG. 3 shows an enlarged partial cross-sectional reverse angle perspective view.

The valve of the present invention is seen in the various figures and generally referred to by the numeral 10. As seen in FIGS. 1 and 2, valve 10 includes an outer housing 12 releasably securable to a base plate 14. As also seen by referring to FIG. 3, removal of housing 12 reveals the pre-mix valve body 16. Valve body 16 is secured to a frame 20 which is, in turn, secured to plate 14. A secondary or cosmetic nozzle 22 is securable to plate 14 and is positioned to receive through a central hole thereof the nozzle outlet portion 24 of valve body 16. A solenoid 26 is secured to a top portion of frame 20 and is held closely against valve body 16. A registering pin 27 provides for the correct positioning of solenoid there against. An actuating lever 28 is pivotally secured to base plate 14 and depends there below. Lever 28 includes an offset end portion 28*a* that is positioned above and through plate 14 and serves to directly contact and operate a switch 30. Switch 30 includes contacts 30*a* for connection to wiring, not shown, and serves to energize and de-energize solenoid 26. Solenoid 26 includes an armature 32 that operates horizontally and is connected to a first lever 34 through engagement with a top end 34*a* thereof. Lever 34 is pivotally secured by a hinge 36 to a bottom portion of frame 20. A second lever 38 is pivotally secured by a hinge 40 from and below a top portion of frame 20. Lever 38 includes a contact bead portion 38*a* oriented towards and adjacent a back surface of lever 34.

Figure 4:
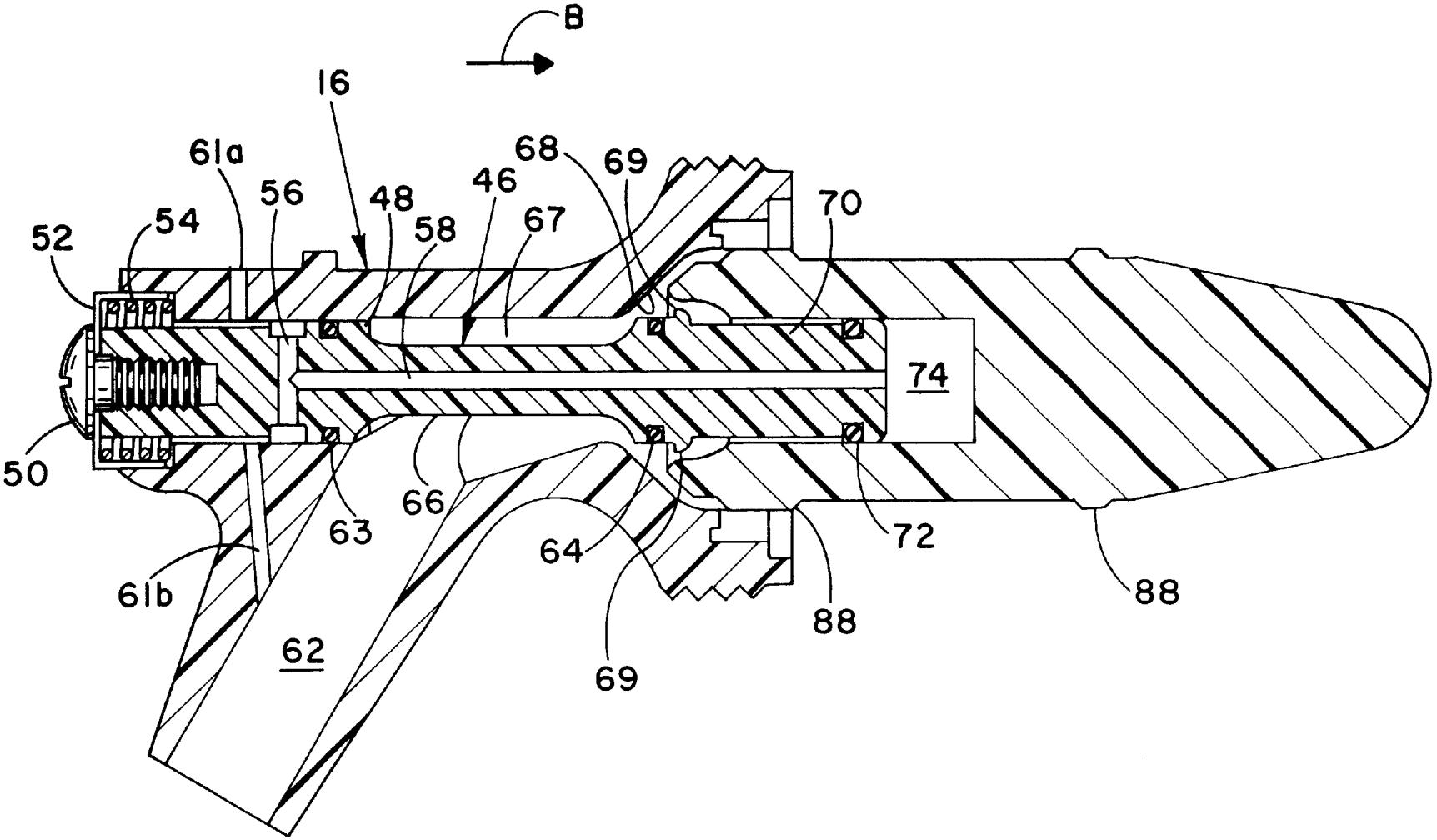
FIG. 4 shows a cross-sectional view of the valve body and components internal thereto in the closed position.
Figure 5:
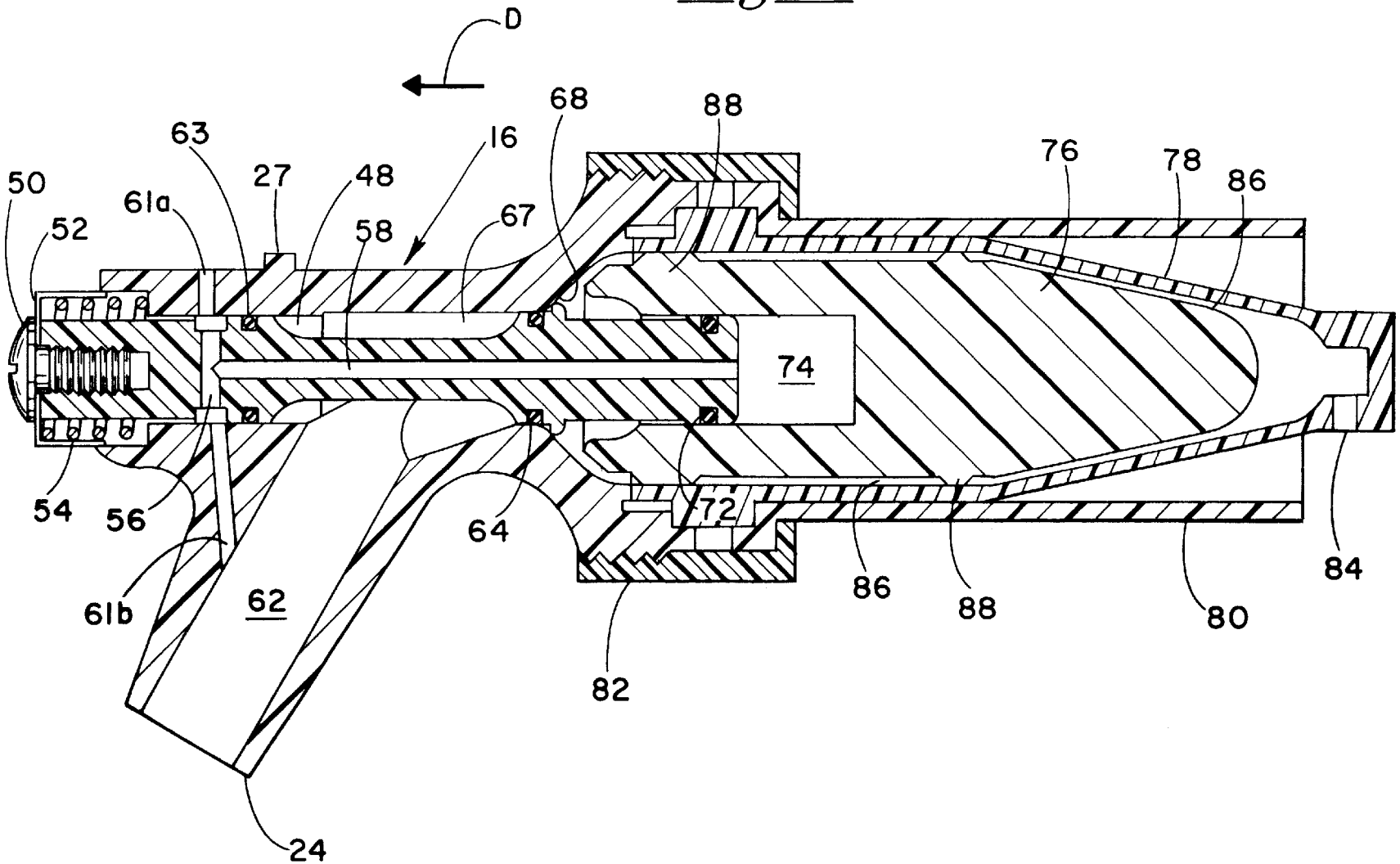
FIG. 5 shows a cross-sectional view of the valve body and components internal thereto in the open position.

A seen in FIGS. 4–6, valve body 16 include a valve shaft 46 extending axially through a central bore 48. Shaft 46 includes a first end receiving a screw 50 therein. Screw 50 secures a spring retaining plate 52 to shaft 46 which serves to retain a spring 54, extending around shaft 46, between a front end of valve body 16 and plate 52. A vertical bore 56 extends through shaft 46 and is in fluid communication with a horizontal axial bore 58 extending centrally through a portion of shaft 16. Valve body 16 includes an upper bore 61*a* there through providing fluid communication with bore 56 and ambient air pressure. A further lower bore 61*b* extends through valve body 16 and provides for fluid communication between bore 56 and a beverage channel 62 that extends centrally of nozzle portion 24. A sealing quad-ring 63 extends through an annular groove in shaft 46 adjacent bore 56 and provides for fluid tight sealing with a forward cylindrical inner perimeter surface portion of bore 48. A second sealing quad-ring 64 extends around shaft 46 and provides for sealing with a rearward cylindrical inner perimeter surface portion of bore 48. A reduced diameter portion 66 of shaft 46 extends between sealing rings 63 and 64 and defines a flow space 67. Bore 48 terminates with a radiussed perimeter surface 68.

As best seen by referring to FIG. 6, shaft 46 includes four stop tabs 69 extending axially therefrom around a perimeter thereof adjacent ring 64. Shaft 46 includes a cylindrical end portion 70 including a third sealing quad-ring 72. End portion 70 is received in a central axial bore 74 of a compensator 76. As is known in the art, compensator 76 is retained in a compensator housing 78. A connecting tube 80 extends around housing 78. As is known in the art, tube 80 and housing 78 are tightly and sealingly held against valve body 16 by a threaded ring nut 82. As is also understood, tube 80 provides for securing of valve 20 to a beverage dispenser, not shown. As is further understood, an inlet 84 of compensator housing 78 provides for fluid tight securing of housing 78 to a source of beverage. A fluid pathway 86 exists between the outer surface of compensator 76 and an internal surface of compensator housing 78. As is known, this flow space is maintained by a plurality of spacing nubs 88 extending from the surface of compensator 76. Also, as is known, compensator 76 is positioned a desired distance away from perimeter surface 68 by a threaded pin 90 received in valve body 16.

In operation, it can be understood that movement of lever 28 by placement of a cup there against operates switch 30 to activate solenoid 26. Armature 32 retracts in the direction of arrow A in FIG. 3, moving lever arm 34 to contact bead portion 38*a* of arm 38. Arm 38 is, in turn, caused to move against screw 50 thereby moving shaft 46 in the direction of arrow B of FIG. 4 to the open position of valve 10, as depicted therein. Quad ring 72 is moved away from contact with surface 68 thereby breaking the seating there between and permitting the flow of beverage out nozzle 24. In particular, and as is known, beverage flows into housing 78 and between compensator 76 and housing 78 past surface 68 and into cavity 67. From there, the beverage flows through channel 62 and ultimately out of nozzle 24 into the cup positioned there below. Upon filling of the cup, it is withdrawn allowing lever 28 to return to its normal position as seen in FIG, 2. Switch 30 is then disengaged and armature 32 extends in the direction of arrow C of FIG. 3. Those of skill will appreciate that shaft 46, under the energy of previously compressed spring 54, moves in the direction of arrow D of FIG. 5, to the closed position of valve 10 as depicted therein.

It was found that solenoid 26 could be relatively small, both in physical size and power rating, yet provide for easy actuating of valve 10. Such reduced force requirement is due 9 in large part to the leverage advantage provided to solenoid 26 by the compound lever structure represented by lever arms 34 and 38. In addition, the lower operating force is provided in part, as is known in the art, by a pressure compensating system represented by central shaft channel 58, bores 61*a*, 61*b*, and 56 and compensator recess area 74.

In the prior art, the valve seat between the central shaft and the valve body was created by a circular resilient surface at the end of the central shaft held at an angle sympathetic with an inclined perimeter surface similar to surface 68. However, over time it was found that some wearing and "plastic" movement would occur such that the central shaft would seat at a position further and further inward of the perimeter surface in the direction of beverage flow. As a result thereof, the operation energy required to unseat the valve would increase. It can be appreciated that tabs 69 serve to prevent such movement and keep the seating position at the same linear point along shaft 46. In addition, tabs 69 permit the use of a quad-ring as the resilient seating surface interacting with the parallel surface of the shaft bore 48. This form of more parallel or sliding seating contact also represents less energy to overcome as opposed to the prior art seating where there is direct or normal pressure contact between the seat and the moving valve structure surfaces. As is understood in the art, bores 61*a*, 61*b* and 56 also provide for full drainage of channel 62 by opening thereof to ambient when shaft 46 is in the closed position depicted in FIG. 5.

In a particular preferred valve embodiment a 24 VAC, 50/60 Hz. input power source is used rectified to 24 VDC to operate a linear solenoid. That valve is designed to provide for a nominal fluid flow rate of 1½ to 2 ounces per second with a nominal static pressure of 50 to 60 pounds per square inch.

From FIG. 1, it can be appreciated by those of skill, that the smaller solenoid permits the use of an outer housing 12 sized and shaped equivalently to known post-mix valves as, for example, manufactured by IMI Cornelius of Anoka, Minn. Of course, the upright manual operating handle is eliminated as well. Thus, valve 10 has the cosmetic appearance of a post-mix valve which appearance is further enhanced by nozzle 22 and cup activation operation as with lever 28. Naturally, those of skill will understand that solenoid 26 can also be activated, for example, by a push button switch located on the exterior of housing 12.

What is claimed is:

1. A pre-mix valve, comprising:

a valve body having a connecting end for connecting the pre-mix valve to a source of beverage and the valve body having a central bore extending there through between the connecting end and a nozzle portion of the valve body, an operating shaft extending through the central bore and operable between an off position for preventing a flow of beverage from the valve body connecting end to the nozzle and an on position for permitting such flow, a powered actuator for operating a first lever arm pivotally secured to the valve body, a second lever arm pivotally secured to the valve body and operable by the first lever by direct contact there with and the second lever operable by such contact with the first lever to move the operating shaft to the open position.

2. The valve as defined in claim 1 and further including a flow compensator in the valve central bore for regulating the flow of liquid there through and the flow compensator having a central bore for receiving an interior end of the operating shaft and the shaft having an axially extending bore there through for providing pressure compensation between the flow compensator central bore and ambient pressure through fluid communication of the operating shaft bore with an ambient pressure channel in the valve body.

3. The valve as defined in claim 1, and the operating shaft extending in the central bore and the shaft having a contact end and an opposite interior end, and the operating shaft having an interior shaft portion extending through an orifice in the central bore and the interior shaft portion having seating means extending around an external surface area thereof for seating with an internal perimeter surface of the central bore orifice and the shaft operable between an off position when the seating means is registered with the internal perimeter surface of the central bore orifice for preventing a flow of beverage from the valve body connecting end to the nozzle, and an on position when the seating means is not registered with the orifice internal perimeter surface for permitting such flow.

4. The valve as defined in claim 3, and further including one or more tabs extending axially from the external surface of the operating shaft interior end, and the tabs extending from the operating shaft at a position thereon whereby the tabs are in contact with a perimeter surface of the central bore orifice when the operating shaft is in the closed position for maintaining the desired register between the operating shaft seat and the internal perimeter surface of the central bore orifice.

5. The valve as defined in claim 1, and further including a valve housing for retaining the valve body therein, the valve housing including a bottom plate and a valve housing cover securable to the bottom plate, and the bottom plate having an orifice for receiving there through the dispensing nozzle.

6. The valve as defined in claim 5, and the plate orifice having a secondary nozzle housing securable thereto.

7. The valve as defined in claim 5, and the first lever arm pivotally secured to the bottom plate.

8. The valve as defined in claim 5, and the powered actuator operated by a cup lever pivotally suspended below the valve body from the bottom plate and the cup lever arm operating a switch for turning on and turning off the powered actuator.

9. The valve as defined in claim 5, and the powered actuator operated directly by a manual.

10. The valve as defined in claim 5, and the first lever arm pivotally secured to the bottom plate.

11. The valve as defined in claim 2, and further including a valve housing for retaining the valve body therein, the valve housing including a bottom plate and a valve housing cover securable to the bottom plate, and the bottom plate having an orifice there through for receiving there through the dispensing nozzle.

12. The valve as defined in claim 11, and the plate orifice having a secondary nozzle housing securable thereto.

13. The valve as defined in claim 2, and the operating shaft having a contact end and an opposite interior end, and the operating shaft having an interior portion extending through an orifice in the central bore and the shaft interior portion having seating means extending around an external surface area thereof for seating with a perimeter surface of the central bore orifice and the shaft operable between an off position when the seating means is registered with the perimeter surface of the central bore orifice for preventing a flow of beverage from the valve body connecting end to the nozzle, and an on position when the seating means is not registered with the orifice perimeter surface for permitting such flow.

14. The valve as defined in claim 13, and further including one or more tabs extending axially from the external surface of the operating shaft interior end, and the tabs extending from the operating shaft at a position thereon whereby the tabs are in contact with a perimeter surface of the central bore orifice when the operating shaft is in the closed position for maintaining the desired register between the operating shaft seat and the internal perimeter surface of the central bore orifice.

15. The valve as defined in claim 2, and the powered actuator operated by a cup lever pivotally suspended below the valve body from the bottom plate and the cup lever arm operating a switch for turning on and turning off the powered actuator.

16. The valve as defined in claim 2, and the powered actuator operated directly by a manual switch.

* * * * *